US005860263A

United States Patent [19]

Sieling et al.

[11] Patent Number: 5,860,263

[45] Date of Patent: Jan. 19, 1999

[54] THICKENED REINFORCED ROOFING SHINGLE

[75] Inventors: Frederick W. Sieling, Bound Brook; William R. Carroll, Sussex, both of N.J.

[73] Assignee: Building Materials Corporation of America, Wayne, N.J.

[21] Appl. No.: 595,542

[22] Filed: Feb. 2, 1996

[51] Int. Cl.[6] ..... E04D 1/00

[52] U.S. Cl. ..... 52/518; 52/523; 52/519; 52/524; 52/525; 52/527; 52/535; 52/555; 52/557

[58] Field of Search ..... 52/518, 519, 523, 52/524, 525, 527, 535, 541, 557, 555

[56] References Cited

U.S. PATENT DOCUMENTS

| | | | |
|---|---|---|---|
| 1,619,601 | 3/1927 | Cumfer | 52/555 |
| 1,958,560 | 5/1934 | Beckman | 52/557 |
| 2,064,473 | 12/1936 | Holdsworth . | |
| 2,171,010 | 8/1939 | Schuetz et al. . | |
| 2,194,427 | 3/1940 | Kirschbraun . | |
| 2,199,760 | 5/1940 | Schuetz . | |
| 3,921,358 | 11/1975 | Bettoli | 52/555 X |
| 4,274,243 | 6/1981 | Corbin et al. | 52/557 X |
| 4,717,614 | 1/1988 | Bondoc et al. | 52/557 X |
| 5,052,162 | 10/1991 | Bush et al. | 52/518 |
| 5,369,929 | 12/1994 | Weaver et al. | 52/518 X |
| 5,426,902 | 6/1995 | Stahl et al. | 52/555 X |

*Primary Examiner*—Carl D. Friedman
*Assistant Examiner*—W. Glenn Edwards
*Attorney, Agent, or Firm*—Marilyn J. Maue; William J. Davis; Walter Katz

[57] ABSTRACT

This invention relates to a rectangular roofing shingle defined as a shingle unit having front and rear stepped edges and having (a) an undivided headlap portion and (b) a butt portion horizontally divided into at least 4 dissimilarly shaped, space-separated, snaggle-toothed tabs which are integral with, and extend from the bottom portion of said headlap and which are recessed from the side edges of said headlap; said shingle unit, having an overall length in inches approximately equal to from about 9 to about 12 inches multiplied by the number of tabs, is secured to a reinforcement strip which is positioned to underlay said tabs, and from about 0.75 to about 5 inches of said adjoining headlap and which has a length equal to the overall length of the shingle unit.

11 Claims, 2 Drawing Sheets

THICKENED REINFORCED ROOFING SHINGLE

BACKGROUND OF THE INVENTION

Roofing shingles comprising a fiberglass mat, organic or inorganic felt or fabric stock impregnated and coated with asphalt and covered with colored mineral granules are well known. For the most part, these have served as relatively inexpensive alternatives to tile, slate and wood roofing shingles. Although such asphaltic shingles are fire-resistant, give good protection and are durable, their substantially planar appearance has made them less pleasing to the eye and less imposing than their more expensive counterparts. Thus, asphalt shingles heretofore available are at a competitive disadvantage with the more expensive roofing shingles because they lack the irregular shadow appearing profiles and surface contours which are characteristic of roofs of wood or slate shingles.

Although lighter weight composite shingles having enhanced dimensionality are more desirable for ease of installation and handling, those which are currently marketed such as those described in U.S. Pat. Nos. 4,717,614; 3,921,358; 5,052,162 and Des. 247,786 are not amenable to stereospecific installation and must be mounted in one direction only on a roof surface. Although the former installability is much to the desired from the standpoint of minimizing material waste and adjustable alignment, no such dimensional shingle is available.

Many futile prior attempts have been made to provide asphalt shingles which would achieve the substantially structural and architectural appearance characteristic of wood or slate roofing shingles. For example, the prior art suggests that an asphalt shingle may be endowed with a massive ornamental effect by securing an additional strip beneath closely spaced tabs of a conventional shingle. However, the structure which is obtained, although massive, still provides only the regular, uniform butt edge profile and surface contour which denotes the common asphalt shingle and further adds to the overall shingle weight without any redeeming weathering advantage.

Also, manufacturers of asphalt shingles have sought to improve the appearance of asphalt shingles by producing them in many colors, and by varying the configuration of the tabs as in U.S. Pat. Nos. 2,194,427; 2,064,473; 2,199,760 and 2,171,010. Attempts have also been made to produce more irregular surface contours as in U.S. Pat. No. 2,099,131 which would give the shingle a bulkier appearance but these efforts have also failed. The goal of producing an inexpensive asphalt shingle providing the physical appearance of the more expensive shingle has until now eluded those skilled in the art.

Accordingly, it is an object of the present invention to overcome the above difficulties and objections and to produce a shingle having markedly increased planar irregularity with substantially no increase in weight by an economical and commercially feasible process.

Another object is to provide a shingle having the above advantages which is aesthetically pleasing and which more closely resembles wood shakes or slate roofing.

Still another object is to provide a unit shingle configuration which permits stereospecific installation of courses on a roof.

These and other objects of the invention will become apparent from the following description and disclosure.

THE INVENTION

In accordance with this invention there is provided an improved, aesthetically pleasing, installation-friendly composite roofing shingle which is more specifically described as a rectangular, shingle defined as a shingle unit having front and rear stepped edges and having (a) an undivided headlap portion and (b) a butt portion horizontally divided into dissimilarly shaped, space-separated, snaggle-toothed tabs which are integral with, and extend from the bottom portion of said headlap and which are recessed from the side edges of said headlap; said shingle sheet, having an overall length approximately equal to from about 9 to about 12 inches times the number of tabs, is secured to a reinforcement member which is positioned to underlay said tabs and from about 0.75 to about 5 inches of the adjoining headlap.

Each composite shingle unit of the invention has 4–5 dissimilarly shaped tabs of from about 2.8 to 8 inch breadth and 3 to 10 inch height and each tab has a distinguishing contour which can be defined by straight or curved lines to form the sides thereof but having at least one marginal edge is defined by a non-continuous line to provide a more rustic appearance and adding an interesting dimension to the appearance of the roof covering. Also, the corners of said tabs can form right, obtuse or scalene angles, thus contributing to a more random appearance. Consequently, the cut out portions between the tabs are correspondingly dissimilar.

Generally, the width of the headlap portion is between about 2 and about 3 times the height of the tabs and the overall width of the shingle unit, i.e. headlap and tab portions is between about 10 and about 25 inches.

One advantage of the present shingle results from its stepped front and rear edges which presents a recessed tab at both the leading and rear edges of the shingle thus permitting stereospecific installation for an optional rear to front or front to rear mounting of courses on a roof, improved ease of alignment adjustment and conservation of roofing material around gables and eaves. In addition to the stepped indentations at the boundary between the headlap and tabbed portions of the shingle sheet, the leading and rear edges of the headlap, at its upper, top or mid section, may include a mateable step extension or indentation which is joinable with an opposing step indentation or extension at its opposite edge to provide locking means in the abutment of shingle units during installation. These additionally stepped edges help to maintain a straight line when mounting a course of shingles.

Another advantage is achieved by the snaggle toothed tabs, each distinguished from the other in a single unit and in an adjoining unit in a pair. This increased variation in shapes of the tabs simulates the irregularities of wood shake or slate roofing.

The reinforcement member which can be conventionally attached or laminated to the shingle sheet has a width at least 0.75 inch, preferably 2 inches or more greater than the height of the overlying tab sections to provide an ample area for adhesion to the lower headlap portion of the shingle sheet. The present reinforced shingle allows for efficient use with no uncommon constraints on installation as is required by shingles described in U.S. Pat. No. 3,998,685.

As in conventional asphalt shingles, the present composite carries weather resistant granules embedded on its exposed surfaces.

Generally, the present shingles can be manufactured by a process similar to that described in U.S. Pat. Nos. 5,052,162 and 3,921,358, both incorporated herein by reference, where a pair of adjacent shingle sheets, for subsequent mounting in abutment, are simultaneously produced from a single on-line roll of asphalt sheeting; the difference being in the cutting pattern of the present shingle sheets and in the subsequent attachment of the reinforcement member or strip.

Alternatively, the present shingle sheets can be manufactured by a process and apparatus which automatically and continuously, produces complementary pairs of shingle units from a shingle sheet having an attached reinforcement strip. The individual units of the pair are suitable for subsequent installation in sequence on a roof. The process begins with a continuous sheet of asphaltic material on which granules may be preembedded or subsequently embedded on its exposed upper surface. A reinforcement strip is preferably attached in a manner later described along the non-exposeable surface mid-section of the sheet to form a composite. The composite asphaltic sheet is fed over rollers to a cutting device having a unique cutting pattern and the resulting composite pieces are separated along the cutting lines into a complementary pair of shingle units. The cutting pattern in the manufacture of the present shingles is unique in that it simultaneously produces two shingle units as a mateable pair suitable for successive installation, having stepped front and rear edges; said pair having individually distinguished tab shapes. Modification in the cutting pattern can be made to accommodate a second pair of steps at the front and rear edges of the headlap as described above.

The reinforcement means is provided by an elongated strip which is preferably attached to the uncut midsection of the shingle sheet covering the entire tab area and between about 0.75 and about 5 inches of the abutting headlap section on both sides of the tab area, e.g. as shown by hatched section 60 in FIG. 5. After cutting the tabs, the reinforcement strip can be left in place or it can be detached and offset by between about 0.75 and about 5 inches to the right or left of the tabs and/or repositioned between about 0.75 and about 5 inches below the tabs to provide a shadow effect in the offset exposed portions thereof. More particularly, the offset to the right, left or base of each tab is between about ⅛ and about ⅓ the length and/or height of each tab. The shadow effect created by this embodiment has a more aesthetic and realistic appearance since the exposed reinforcement areas conform exactly to the irregular contours of the snaggle tooth tabs while providing tab double thickness and reinforcement at upper corners where the tabs abut the headlap. In the embodiment where the reinforcement means is offset, it is desirable that it be of a darker color for contrast in the shadowed exposed areas as illustrated in FIG. 6 of the drawings where both lateral and vertical displacement is shown.

Alternatively, reinforcement can be provided by a separate elongated, rectangular strip having a length equal to the overall length of the shingle unit. In this case, the elongated rectangular strip is attached after the tabs are cut and is positioned to the under surface of the headlap and abutting top portions of the tabs as shown in FIGS. 2 and 3. Between about 0.75 and about 5 inches, preferably between about 2–3 inches, of the upper marginal portion, e.g. the top marginal edge, of the reinforcement strip is laminated to the under surface of the overlapped headlap and is positioned to extend from about 2 to about 5 inches below the top boundaries of the tabs for exposure in the tab spaces, e.g. as illustrated by top view in FIG. 3. As above, it is desirable that the reinforcement strip be of a darker color for contrast in the exposed shadow areas and for added dimensionality.

THE DRAWINGS

More particular reference is now had to the accompanying drawings wherein FIGS. 1 through 5 are plan views of the present shingle unit or units.

FIG. 4 also illustrates a cutting pattern used on felt sheeting to provide a complementary pair of shingle units.

DETAILED DESCRIPTION OF THE DRAWINGS

Figure 1:
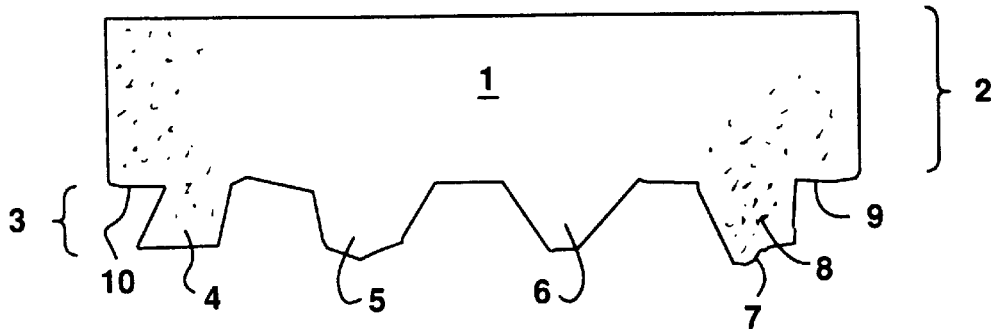
FIG. 1 is a 4 tabbed shingle sheet.

FIG. 1 is a top view of rectangular, asphalt impregnated shingle unit 1 having stepped rear and leading edges, shown by numerals 9 and 10 respectively, and having headlap portion 2 and a contiguous butt portion 3 having four dissimilar, snaggle-tooth tabs 4–7 which are unevenly spaced apart and are recessed from the front and rear edges of the headlap from which they depend. In the most preferred embodiment the dimensions of the shingle unit is between 35–45 inches long and 15–17 inches wide, e.g. 40×17 inches. Tabs 4–7 can have an average height of between about 3 and about 9 inches (as represented here, about 5 inches) and carry on their weather exposeable surfaces mineral granules 8 which granules preferably cover the entire surface of unit 1.

Figure 2:
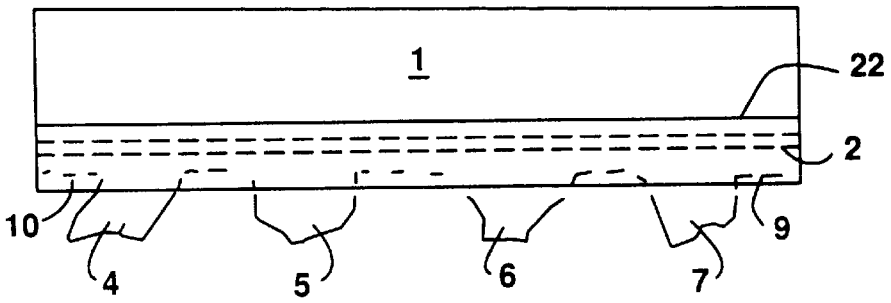
FIG. 2 shows a reinforcement strip suitable to underlay the tabs and lower portion of the headlap of shingle unit shown in FIG. 1.

As shown in FIG. 2, surface granules, asphalt impregnated reinforcement strip 22 having a length equal to that of headlap 2 and a height 0.75–5 inches greater than the height of tabs 4–7 (e.g. 2–3 inches greater than the height of the tabs), is attached to the undersurface of headlap 2 and extends 0.75 to 5 inches over the top marginal boundaries of tabs 4–7. The overlap of tabs 4–7 is shown by broken line. Said strip 22 is attached to the headlap portion by adhesive patches 12 located between the unexposed reinforcement strip surface and the under headlap surface of unit 1.

Figure 3:
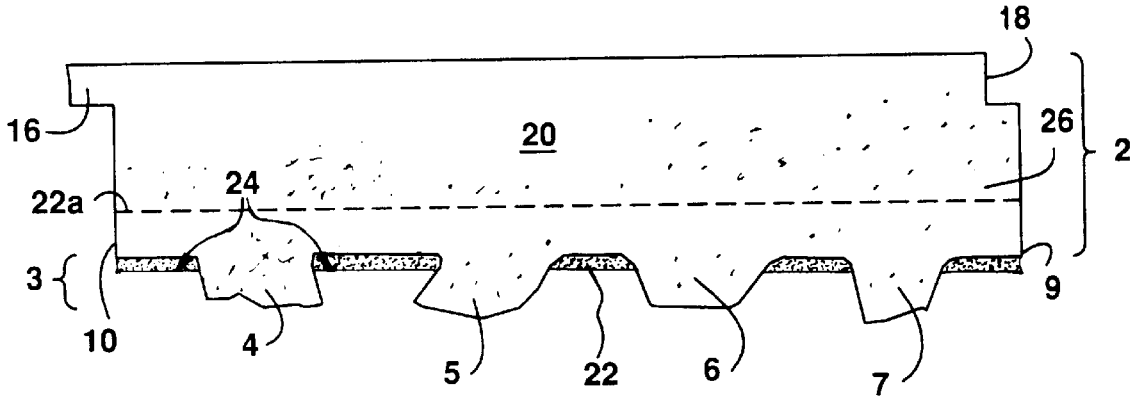
FIG. 3 is an assembled modified shingle unit having multiple stepped rear and front edges and having a shadow line reinforcement strip.

FIG. 3 is a top plan view of an assembled composite shingle unit 20 wherein the upper leading and rear edges of headlap 26 are modified by slots 16 and 18 which are interlockable with a succeeding or preceding shingle unit and which provide a shingle sheet having multiple stepped side edges, as shown by numerals 10 and 16 on the leading edge and numerals 9 and 18 on the rear edge of unit 20. In this embodiment, the bottom marginal edge of surface darkened reinforcement strip 22 extends below the top boundaries of tabs 4–7 to display thickened, darker exposed area 24 in the spaces between the tabs; thus providing additional dimensionality to the shingle unit. The top marginal boundary of reinforcement strip 22 is shown by broken line 22*a*. The front and rear edges of reinforcement strip 22 are in alignment with the forward and rear edges of headlap 26.

An advantage of shingle units 1 and 20 in FIGS. 1 and 3 is the economy of their manufacture wherein two complementary units are made simultaneously from one larger piece of asphalt impregnated sheeting, absent preattachment of a reinforcing strip, which sheeting is at least equal in length to unit 1 or 20 but wider by a dimension equal to the height of one headlap portion. When the larger sheeting is divided into two segments by a unique cutting pattern, the shape-distinguished tabs of one segment are formed by the correspondingly irregular shaped spaces between conversely shaped tabs of the other segment. Thus, the uncut asphalt-impregnated sheeting is more economically utilized.

Figure 4:
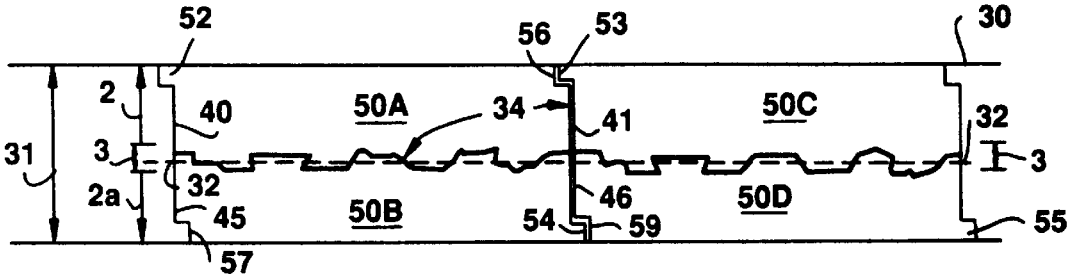
FIG. 4 shows pairs of shingle units cut from asphaltic sheeting in the manufacture line before separation.

More specifically, shingle unit 20 of FIG. 3 or 1 of FIG. 1 can be manufactured from asphalt-impregnated sheeting 30 by the unique cutting pattern shown in FIG. 4. Sheeting 30 is at least equal to the length of the finished shingle sheet and is of a width 31 equal to twice the height of the headlap portion 2 plus the height of the butt portion 3 of a finished complementary shingle unit pair. The centerline of sheeting 30 is indicated by 32 which is midway the average height of the tabs and midway between the upper and lower marginal boundaries of the sheeting. Sheeting 30 is divided by cutting along a predetermined and irregular shaped horizontal path 34 on either side of, and at approximately an equal distance from centerline 32 and is also cut vertically at 40, 41, 45 and 46, to form predetermined front and rear edges of a pair of shingle units, as shown by the heavy horizontal and vertical cutting lines of FIG. 4, to obtain two complementary unit pair segments 50A and 50B and unit pair segments 50C and 50D.

The cutting pattern for a complementary pair of shingle units corresponding to sheet 1 of FIG. 1 is similar except the vertical cutting lines defining the leading and rear edges of the units are straight instead of slotted as in FIG. 4 and the cutting line which defines the individualized tabs are altered in corresponding shape.

The tabs of each segment of the complementary shingle unit pair are of an individually distinguishable shape, since one segment is the reverse complement of the other.

Figure 5:
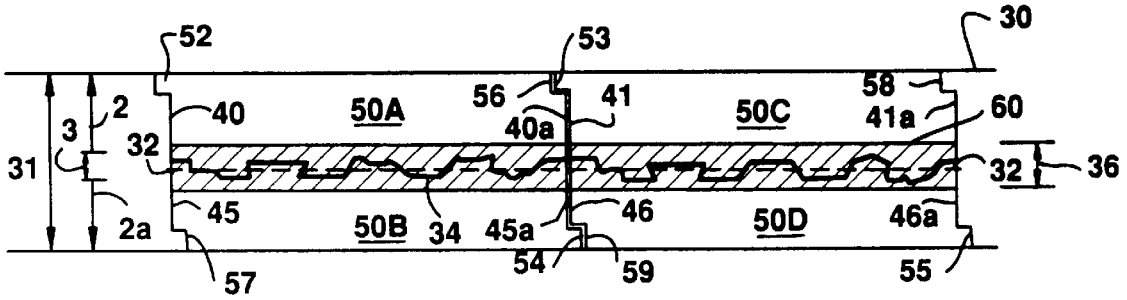
FIG. 5 illustrates the attachment of a reinforcing member prior to cutting.

FIG. 5 is an under plan view of the asphalt impregnated sheeting-shown in FIG. 4 having the same cutting pattern; however in this embodiment, reinforcing strip 60 is attached to the mid-section along the longitudinal plane of the sheet. The width of said strip is equal to area between the top and bottom marginal edges of the tabs in a pair of complementary shingle units, defined by the horizontal cutting line, plus an additional 0.75 to 5 inches disposed on both sides of area 3 in order to provide sufficient overlap of headlap portions 2 and 2*a* after the shingle unit pair is separated. The attached reinforcement strip in FIG. 5 is shown by hatched area 36. Upon separation of the shingle pair following shingle sheet cutting, each tab has a double thickness provided by the reinforcement strip which conforms exactly to the outline of the tabs. The strip in this embodiment offers maximum reinforcement at the upper corners of the respective tabs and is most beneficially employed in areas subject to severe climatic conditions.

Figure 6:
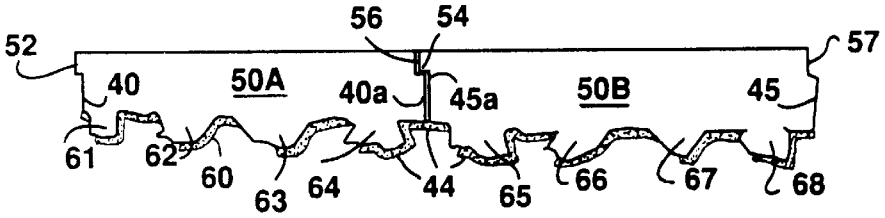
FIG. 6 shows a mated pair of complementary shingle units with an attached offset reinforcement member.

FIG. 6 shows separated shingle unit segments of shingle pair 50A and 50B in FIG. 5 which are mounted in series so that leading edge 45*a* of segment 50B is jointed to and interlocked with the rear edge 40*a* of segment 30A. FIG. 6 also shows reinforcement strip 60 which has been detached after sheet cutting and which is offset and repositioned to the right and below tabs 61 through 68. The reinforcement strip is of a darker color to provide distinctive shadow line 44 and added tab thickness.

Although the above disclosure is directed to composite shingle units, it will be understood that the present invention also pertains to shingle units having no reinforcement strip member and where courses of sheets are installed on a roof in an overlapping manner so that the tab portion of one sheet course overlaps the lower headlap portion of the course immediately preceding and said lower portion of the preceding headlap portions are exposed and completely fill the spaces between the tabs of the succeeding course of shingles. These shingles are particularly well suited for use with conventional selfsealing adhesive. Groups of adhesive spots or a band of adhesive can be employed on the headlap portion immediately adjacent the butt portion to adhere the butt portions of the shingles of the adjacent overlying course thereto. Alternatively, the adhesive spots may be applied to the under portion of the extended tabs. This is possible because the courses of shingles overlie each other in flush contact.

What is claimed is:

1. In a laminated, asphalt impregnated, felt roofing shingle unit comprising (a) a top sheet member having front and rear stepped edges and having an undivided headlap portion and a butt portion horizontally divided into spaced tabs which are integral with and extend from the bottom marginal boundary of said headlamp and (b) an elongated reinforcement member underlying the tabs and at least the lower portion of said headlap and having its leading and rear edges conterminous the leading and rear edges of said headlap, the improvement which comprises (1) said butt portion horizontally divided into at least 4 dissimilarly shaped, snaggle-toothed tabs each having at least one marginal edge defined by a non-continuous line and having differently shaped spaces between pairs of said tabs and (2) a reinforcement member which exactly conforms with the shape of the tabs and which is positioned to underlay at least a portion of said headlap and to extend from a marginal boundary of each tab.

2. The shingle unit of claim 1 wherein a marginal side edge of a tab is defined by a non-continuous line.

3. The roofing shingle of claim 1 wherein said reinforcing member is positioned to offset at left or right side of said tabs between about ⅛ to about ⅓ the average width of said tabs so as to provide an exposed surface of said member at said offset sites and wherein the lower marginal edges of said member is conterminous with the bottom edges of said tabs.

4. The roofing shingle of claim 1 wherein said reinforcing member is positioned to extend below said tabs by between about ⅛ and about ⅓ the average length of the tabs to provide an exposed member surface at the bottom of said tabs and wherein the sides of said member positioned below said tabs are contiguous with the sides of said tabs.

5. The roofing shingle of claim 4 wherein one side reinforcing member is positioned to offset the right or left side of said tabs by between about ⅛ and about ⅓ the average width of said tabs so as to provide an exposed member surface at a side and bottom portion of said tabs.

6. The roofing shingle of any one of claims 3, 4 and 5 wherein said reinforcing member is colored darker than the headlap and tabs of the shingle unit so as to provide a shadow effect by the exposed member areas of darker color.

7. The roofing shingle of claim 1 wherein the width of the reinforcing member is between about 0.2 and about 0.85 times the width of the headlap in a single unit.

8. The roofing shingle of claim 1 wherein the width of the reinforcing member is at least 0.75 inch greater than the average height of said tabs.

9. An adjoining pair of shingle units of claim 1 wherein each tab has a shape distinguished from the others.

10. The adjoining pair of shingle units of claim 9 wherein the spaces between the tabs have a dissimilar shape.

11. The adjoining pair of shingle units of claim 10 wherein the outline of said spaces between said tabs correspond conversely to the outlines of said tabs.

* * * * *